United States Patent [19]

Leifheit

[11] Patent Number: 4,798,119

[45] Date of Patent: Jan. 17, 1989

[54] FIXED FINGERING DEVICE FOR FRETTED STRINGED MUSICAL INSTRUMENT

[76] Inventor: Eric S. Leifheit, 7541 E. 34th St., Tucson, Ariz. 85710

[21] Appl. No.: 113,053

[22] Filed: Oct. 27, 1987

[51] Int. Cl.[4] ..... G10D 3/14

[52] U.S. Cl. ..... 84/314 R; 84/312 R; 84/316

[58] Field of Search ..... 84/173, 267, 297 R, 84/308, 312 R, 314–316, 318

[56] References Cited

U.S. PATENT DOCUMENTS

| | | | |
|---|---|---|---|
| 668,060 | 2/1901 | Shelton | 84/314 R |
| 692,751 | 2/1902 | Winchell | 84/318 |
| 3,290,980 | 12/1966 | Fender | 84/307 |
| 3,447,411 | 6/1969 | Bloxsom | 84/264 |
| 3,599,524 | 8/1971 | Jones | 84/312 |
| 3,783,731 | 1/1974 | Pash | 84/173 |
| 4,006,657 | 2/1977 | Dunnette | 84/314 R |
| 4,208,941 | 6/1980 | Wechter | 84/298 |
| 4,304,163 | 12/1981 | Simonoff | 84/314 N |

*Primary Examiner*—Lawrence R. Franklin

*Attorney, Agent, or Firm*—J. Michael McClanahan

[57] ABSTRACT

An inventive positioner adapted to secure a string of a guitar or other fretted stringed instrument at fret positions in order to quickly and easily vary the length of the string available for vibration to change the pitch when the string is plucked. The positioner describes a threaded machine screw received in a metal insert, the insert fixedly held in the fretboard of the neck of the guitar. The positioner screw is angled at a preferred 55° angle with respect to the fretboard and so positioned that it hooks the string in a locking downward "V" catch to secure holding the string against the fretboard so that the string will rise up and engage the adjacent fret between the positioner and the guitar main body. The guitar string is not moved laterally when it is engaged and held.

A plurality of positioners are provided for each of the guitar strings behind each fret throughout the length of the fretboard in order that each guitar string effective vibrating length may be changed as desired. After use, the positioner is unscrewed to release the guitar string.

7 Claims, 1 Drawing Sheet

FIXED FINGERING DEVICE FOR FRETTED STRINGED MUSICAL INSTRUMENT

BACKGROUND OF THE INVENTION

1. Field of the Invention

The field of the invention is means for fixing the fingering of a guitar string or other fretted stringed musical instrument string.

2. Description of Related Art

In guitars and other fretted musical instruments, one or more strings are stretched under tension across a sounding board or other main body of the instrument which, upon the string vibrating, amplifies and emits a sound. One end of the strings are anchored at one side of the main body or sounding board, strung across the sounding board, and along an elongated neck portion attached to the main body. The other end of the strings are then anchored at the end of the neck away from the main body to tuning pegs or other devices which permit adjustment of the string tension. At variously determined intervals along the neck portion are a plurality of frets, i.e., transverse ridges which underlie the plurality of strings and which in turn are resting upon a fretboard. The strings do not touch the frets, even during vibration.

On guitars or other fretted stringed musical instruments it is common for the musician to use the hand not plucking the strings to press one or more strings of the instrument with one or more fingers to the frets along the neck of the guitar or other musical instrument.

The sound emitted from a plucked string is termed its pitch and is determined by the relationship of the tension of the string, its mass per unit length which is a function of the string's diameter, and the length of the string available for vibration (effective length). The effective length of the string is the distance between the first anchor attached to the main body of the fretted stringed instrument, called the bridge, and a second anchor, called the string nut. Many times, all the strings ride over a saddle which is immediately adjacent to the bridge. The effective length then starts at the saddle. At the neck far end is the second anchor, the string nut over which all of the strings pass and contact immediately before they are attached to the tuning pegs.

To change the pitch of the string, one merely shortens the string and to accomplish this, the player need only to press down on the string to engage one of the frets on the fretboard portion of the neck of the instrument. This procedure reduces the effective string length to the distance between the saddle and the fret. As a general rule, the 12th. fret on a guitar is located one-half of the distance between the saddle and the string nut. If the string is held at the 12th. fret, the pitch doubles. A violinist or guitar player is constantly fingering the instrument as he plays it, using the fingers of the hand not plucking the strings or drawing a bow across the strings to change the pitch as called for by the musical score.

It has been determined that it would be useful to mechanically finger one or more strings of a stringed instrument for a changed, but constant pitch, during a whole musical number while at the same time making the instrument strings, including the mechanically fingered string, still available for further fingering by the musical player. It is to this invention that the subject patent is directed.

SUMMARY OF THE INVENTION

The invention relates to a device for mechanical fingering of a fretted stringed musical instrument such as a guitar, violin, ukulele, or the like. Fingering is accomplished by the process of shortening one or more strings of the musical instrument to produce a pitch different than the usual unaltered frequency.

The positioning devices or positioners which are the means to mechanically finger the instrument include machine screws and screw receiving inserts placed at specific locations immediately behind frets on the fretboard of the stringed instrument neck. The machine screw is so angled such as to hook over or clamp the instrument string in a captured position between the threaded shaft of the screw, the underside of the screw head, and the fretboard upper surface to hold the string down so that it will be fixedly held at the immediately adjacent fret. The screw is so situated on the fretboard that when it engages the string and holds it down, the string is not moved laterally from its previous unengaged position. The insert is attached to the fretboard by mechanical means or by an adhesive at and angle of 55° with respect to the top surface plane of the fretboard. The screw positioner follows the same 55° angle. One positioner engages one string at one fret.

The insert is located just below the top surface of the fretboard and a recess is also cut into the fretboard to receive the positioner screw head in order that the head be below the level of the adjacent fret when the positioner is not being used to engage the string. When the positioner is not being used, it is screwed down to its lowest position so as to be out of the way of the vibrating string or present an obstruction to easy movement of the player's fingers over the strings in the process of fingering the strings during the playing of a musical selection.

Preferably, there is one positioner for every string located behind every fret on the neck of the guitar or other stringed instrument. By means of the mechanical positioners, a player may fixedly finger the musical instrument for a complete musical selection to change one or more string pitch and then just as easily unscrew the positioner and release the held string with a screwdriver, coin, or fingernail.

It is an object of the subject invention to provide a mechanical device for mechanically fingering a fretted stringed musical instrument.

It is another object of the subject invention to provide a mechanical device so that various lengths of a stringed instrument string can be fixed for different pitches of the strings of the instrument.

It is still a further object of the subject invention to provide a positioning device proximate every fret for every string of the instrument to provide complete pitch selection of strings of a fretted stringed instrument.

It is still another object of the subject invention to provide a mechanical device for varying string pitch of a fretted stringed instrument where the device, when not being used, is out of the way of the vibrating strings and fingers of a player.

Other objects of the invention will in part be obvious and will in part appear hereinafter. The invention accordingly comprises the apparatus comprising the construction, combination of elements, and arrangements of parts which are exemplified in the following detailed disclosure, and the scope of the invention which will be indicated in the claims.

BRIEF DESCRIPTION OF THE DRAWINGS

For further understanding of the nature and objects of the present invention, reference should be had to the following detailed description taken in connection with the accompanying drawings wherein.

In various views, like index numbers refer to like elements.

DETAILED DESCRIPTION OF THE PREFERRED EMBODIMENT

Figure 1:
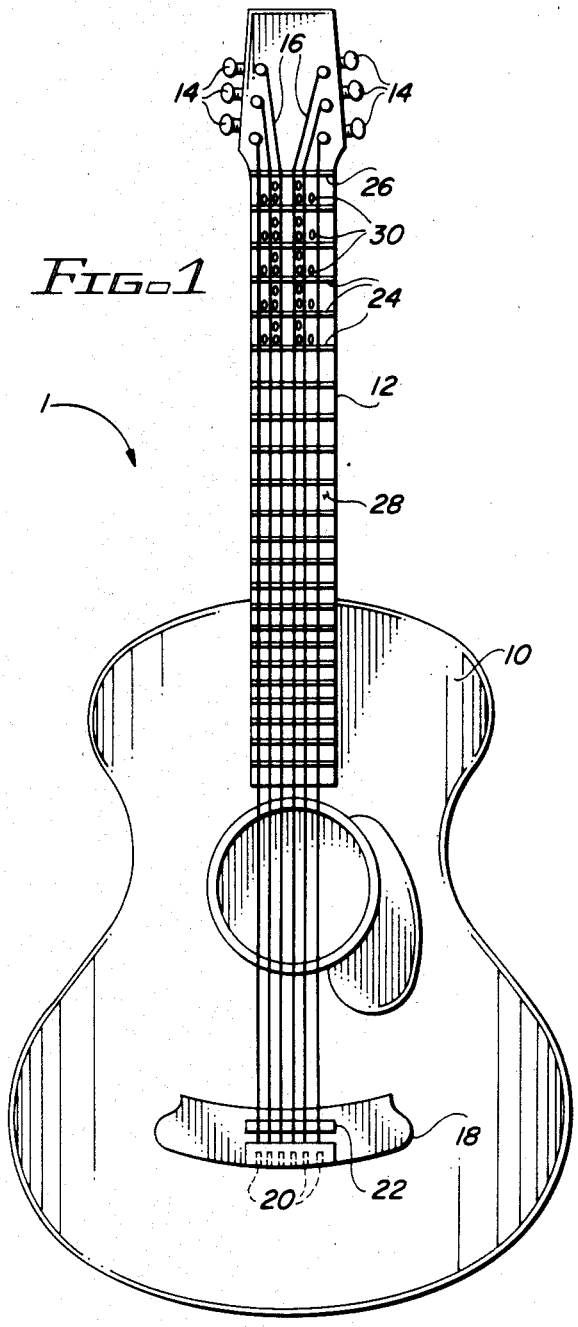
FIG. 1 is a top view of a fretted stringed instrument showing the invention in place.

Referring now to FIG. 1, a top view of a fretted stringed instrument, here a guitar, is shown with the inventive positioners in place. Firstly, guitar 1 comprises main body 10 and connecting neck 12. Rotatably mounted at the distal end of neck 12 are a plurality of conventional tuning pegs 14 which permit adjustment of the string tension. Each peg 14 has a shaft associated with it around which is wrapped one end of a guitar string 16. Strings 16 ride over and are supported by string nut 26 near the end of neck 12. The other end of the strings 16 are anchored to a bridge 18 by a plurality of conventional bridge pins 20. Strings 16 ride over and are supported by bridge saddle 22. The strings effective length, i.e., that length available for vibration, is the length between the string nut 26 and the bridge saddle 22.

Situated upon the neck 12 is the fretboard 28 which constitutes the top surface of neck 12, and is immediately underneath, but not touching, strings 16. Mounted at spaced intervals upon fretboard 28 are frets 24 which protrude spatially above fretboard 28, but also do not engage guitar strings 16, even when the strings vibrate. Thus, in the illustration shown in FIG. 1, each of the six guitar strings are supported at opposite ends by bridge saddle 22 and string nut 26, and there is no other parts touching the strings between these two elements.

The invention is shown situated on the fretboard 28 between frets 24 proximate the distal end of neck 12. The means by which strings are mechanically fingered comprises a plurality of positioners 30 properly situated and aligned relative to guitar strings 16 in order that when one or more are used, they will secure individual strings at chosen frets and do not shift the strings laterally as they secure the individual strings.

Figure 2:
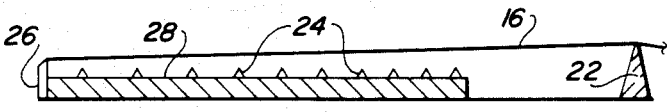
FIG. 2 is a side view of one string of a simplified fretted stringed instrument.

FIG. 2 is a side view of a guitar or other fretted stringed instrument showing the various elements between the bridge saddle 22 and the string nut 26 in an simplified way. Fretboard 28 located on the neck of the guitar has the plurality of frets 24 spaced along it according to a predetermined mathematical formula. Frets are ridges which rise up above and cross transversely the fretboard. String 16 is elevated above both the fretboard 28 and each of the frets 24. Frets are commonly named in consecutive order as the first fret, second fret, third fret, etc., commencing with the first fret next to the string nut. Shown in FIG. 2 is the first fret through the tenth fret. As a general rule (although not shown in FIG. 2), the twelfth fret falls halfway between the string nut and the bridge saddle.

The height of guitar string 16 above fretboard 28 and frets 24 is determined by the heights of string nut 26 and bridge saddle 22. Since most guitars have six strings which generally range in thickness between 0.10 to 0.50 inches and are under different tensions such that each string has a chosen particular vibrating frequency or pitch, sufficient allowance for these factors must be taken into consideration when determining the height of the string nut and bridge saddle. Other fretted stringed instruments have the same considerations.

Figure 3:
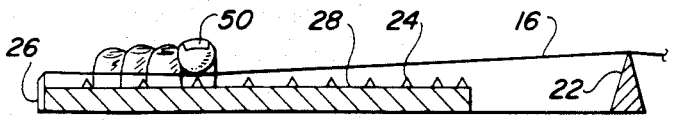
FIG. 3 is a side view of one string of a simplified fretted stringed instrument showing a player fingering the string of the instrument.

The vibrating frequency of a guitar string is changed when the guitar player holds or fingers one or more strings against a fret as shown in the example of FIG. 3. Here, the player has placed his finger 50 upon string 16 at the third fret. In doing so, the effective length of the vibrating string is now from the bridge saddle 22 to the point where the finger holds the string against the third fret whereas previously, the effective length of string 16 was the distance between bridge saddle 22 and string nut 26. In addition, by pushing string 16 down, the tension in string 16 has been slightly increased. Accordingly, the vibrating frequency, and thus pitch, of string 16, being a factor of effective string length, string mass (determined by the string thickness) and tension results in a different pitch than was the case before the string was forced to engage the third fret. The guitarist then strums or plucks the strings between bridge saddle 22 and the area of the fretboard 28 closest to the bridge saddle to create the sound.

If one has watched a guitar player, it is noticed that the player strums or plucks the guitar strings with one hand while the other hand is moving up and down the guitar neck holding different strings at different frets. By such maneuvers, different pitches and sounds emanating from the strings are produced, and one string may theoretically take on as many different pitches as there are frets on a guitar. It is not necessary to hold the string exactly against the fret as shown in FIG. 3 as it is apparently obvious that if the person's finger, or fingers, were placed between the third and the second fret of FIG. 3, string 16 would still rise up upon the third fret which would then determine the length of the string available to vibrate. In the simplified example shown in FIG. 3, pressing the string 16 down to the fretboard 28 between the third and second frets would increase the tension in string 16 over that shown in FIG. 3 because the string would have been stretched a little farther in being urged to the top of the fretboard rather than the top of the fret. How much pitch a string would change from a desired new pitch would obviously be a function of a number of factors including, but not limited to, the height of fret 24 above the fretboard 28. These are matters which may be compensated for in different ways, such as by location of the frets. In addition, it may be that the pitch of a string is not appreciably changed since the square root of the tension is used in calculating the vibrating frequency.

There are occasions when the guitar player wishes to play a musical number with one or more of the strings having a modified or changed pitch which is then to remain constant throughout the musical number. This may be accomplished very simply by the guitar player placing his fingers at the appropriate frets for the appropriate strings and leaving his hand there throughout the musical number. However, since generally only four fingers are available, and most guitars have six strings, only four strings could be held against different frets unless one finger is holding more than one string. Normally, the thumb is not used to hold a string down. Even then, the guitar player is limited by the dexterity of his fingers and the length of his fingers as to which strings and frets will be involved. Further, if the guitar player is holding the strings constantly against the frets during the playing of the musical number, he can't be moving that hand up and down changing the pitch of the vibrating strings from the pre-chosen pitch.

Figure 4:
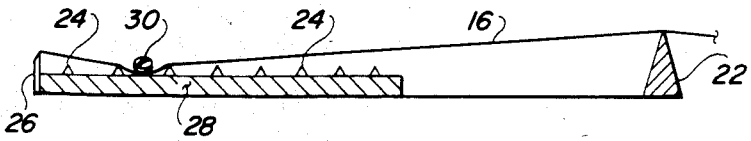
FIG. 4 is a side view of one string of a simplified fretted stringed instrument showing the invention in place behind one of the frets.

This is where the instant invention shows its function and usefulness. FIG. 4 is a simplified view of a guitar and string such as illustrated in FIGS. 2 and 3 where the inventive positioner now holds a guitar string down at a selected fret position to achieve a specific pitch for that string. Now, that same string may have its pitch further modified by the guitar player fingering the string against a fret nearer the bridge saddle 22. Referring specifically to FIG. 4, positioner 30 is shown securing guitar string 16 in place between the second and the third frets located on fretboard 28. Now string 16 is firmly held to the third fret, the same as when finger 50 shown in FIG. 3 held string 16 at the third fret, and thus the resulting pitch of string 16, when plucked, is the newly desired pitch, the same as would be achieved by the string of FIG. 3.

Figure 5:
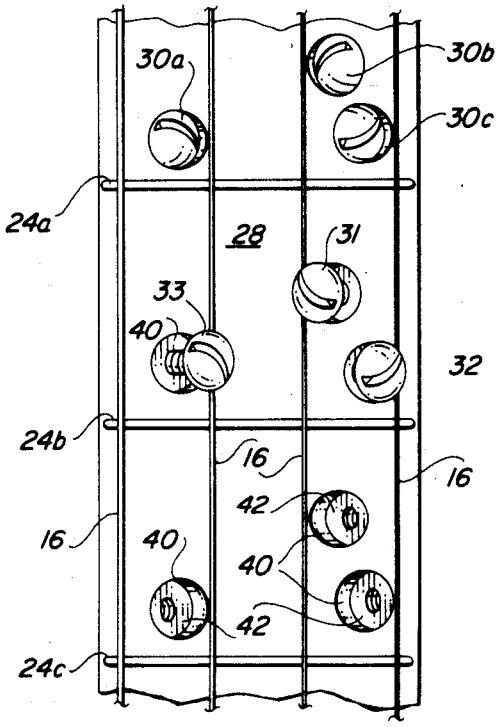
FIG. 5 is a partial top view of the neck of a fretted stringed instrument showing the invention operating in place.

FIG. 5 is an expanded top view of a portion of a fretboard showing a number of positioners, some engaging the guitar or other fretted instrument strings and some recessed into the fretboard such as not to interfere with either the strings when they vibrate, or with the player's fingers should he move them up and down the fretboard. Shown in FIG. 5 are specific positioners 31 and 32 engaging different strings. Positioners 30 (including specific positioners 31, 32, and 33) comprise a flat or round headed machine screw with a slot in its head to receive a screwdriver, coin, or fingernail so as to rotate in or out the screw. Positioners 31 and 32 have engaged the strings and are tightened down to the fretboard 28 to hold the string at fret **24*b* which, if consistent with FIGS. 2 and 3, is the third fret. The view of the heads of positioners 31 and 32 are shown in perspective because the positioners are angled with respect to the flat surface plane of the fretboard 28. The reason for this is so that when string 16** is held by each positioner, it is held such that the shaft and the head of the screw comprising the positioner hook over or clamp down over the string forcing it against the fretboard in such a manner as to prevent the string from sliding out from under the screw head. This is better shown in the following figures.

Positioner 33, also with its head shown in perspective, is not engaging a string but is screwed out away from fretboard 28 and has its shaft pointed at an angle downward into FIG. 5 and to the right. In this manner, as positioner 33 is screwed back towards fretboard 28, it will engage string 16 between its central shaft and head and not move the string laterally when the screw is at its finally bottoming position. Shown immediately to the left of head positioner 33 is recess 40 formed in the fretboard 28 adapted to receive the head of positioner 33 when the positioner is not being utilized to hold down a string. By this means, the head is out of the way of the vibrating string.

In the upper portion of FIG. 5 are three more positioners, **30*a*, 30, *b*, and 30*c***, which are not being utilized and which have been screwed down into the fretboard so that their heads do not protrude above the fretboard, or at least not above the adjacent frets so as to interfere with the strings or the guitar players fingers.

Shown in the lower portion of FIG. 5 are the recesses 40 formed in the fretboard 28 which receive the heads of the positioners. Obviously, in the lower portion of FIG. 5, the positioners have been removed. Centrally to recesses 40 are threaded brass or other metal inserts 42 which receive the threaded shaft of the screws which comprise the positioners. It is noted that all the positioners, and the recesses shown in FIG. 5 are shown in perspective since, as earlier mentioned, the inserts and thus the positioners are angled in order that they come down over the strings to secure the string between the positioner shaft and head and to keep the string from slipping out which might well be the case if the shaft of the screw comprising the positioner were perpendicular to the fretboard.

Figure 6:
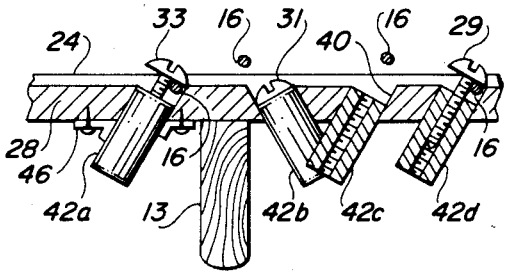
FIG. 6 is a partial cutaway view of the cross-section of a fretted stringed instrument neck showing the invention in place and operating.

FIG. 6 is a partial cutaway view of three positioners, two presently holding strings down and one screwed into its recess in the fretboard, and one brass insert without a positioner. Firstly, fret 24 is shown running transversely across the fretboard 28 with neck reinforcement 13, which runs the whole length of the neck, attached thereto for strengthening. Commencing from the left and proceeding right, positioner 33 is shown holding down string 16 to the top surface of fretboard 28. Naturally, string 16 rises up after positioner 33 to engage the top of fret 24. Brass insert **42*a*, which has a central threaded hole longitudinally therethrough, receives the threaded shaft of positioner 33. Insert 42*a* is secured to fretboard 28 by mechanical fastening mean such as a collar with a flange or it may be held by an adhesive. As way of example, collar and flange 46 are shown attached to insert 42*a* and to the lower surface of fretboard 28**.

As stated above, the shaft of positioner 33, in combination with the lower side of the head of positioner 33, co-act to hold string 16 in a secured position against the fretboard (here the sides immediately adjacent the recess) from which it may not become loose until positioner 33 is unscrewed and the string moved away from the positioner and then the positioner screwed back down. In FIG. 5, positioner 33 was shown in a position considerably above guitar string 16, preparing to screw down the positioner to hold string 16. In FIG. 6, positioner 33 has been screwed down and guitar string 16 is secured.

Proceeding rightward in FIG. 6, positioner 31 is shown no longer holding guitar string 16 as in FIG. 5, but is now screwed down to its lowest position in insert **42*b* where it s head is recessed below the top surface of fret 24. At this point, string 16 is shown above and not touching fret 24. In front of positioner 31 in its insert 42*b* is another insert, 42*c*, here shown in half section to reveal the threaded hole interiorly to the brass insert. Positioner 32 shown in FIG. 5, has been removed from insert 42*c* to illustrate the recess 40 formed in fretboard 28 immediately above the top of insert 42*c*. Again, guitar string 16, which would be engaged by the positioner 32 in brass insert 42*c*, is shown also above the fret 24. Lastly, at the full right, is shown positioner 29 engaging guitar string 16 holding it to the fretboard 28 in order that it will rise up and engage fret 24. Insert 42***d* receives positioner 29.

As shown in FIG. 6, and as stated in the description of FIG. 5, the positioners are preferably placed in a position so that the threaded shaft of each positioner is at an angle of approximately 550 with respect to the horizontal, or 350 with respect to the vertical.

While for convenience positioners have been shown in the very end portion of neck 12 of FIG. 1, it is realized that the positioners are placed in fretboard 28 throughout the whole length of the fretboard.

Advantages of the invention are among others, that the player is able to do chords which would have been impossible to do due to the limitation of numbers of fingers and stretch of fingers. In addition, sympathetic vibration of adjacent strings is also enhanced by virtue that the player can secure selected adjacent strings to maximize harmonic relationships.

While a preferred embodiment has been shown and described, it will be understood that there is no intent to limit the invention by such disclosure, but rather it is intended to cover all modifications and alternate constructions falling within the spirit and the scope of the invention as defined in the appended claims.

I claim:

1. On a fretted stringed musical instrument having a vibrational length of string stretched between two points overlying a plurality of frets on the instrument fretboard surface, a positioner mechanically fingering the string to selectively vary the string vibrational pitch comprising:

means to secure the string at a selected position to selectively vary the vibrational length of the string, said means including an insert fixedly attached to the fretboard of the stringed instrument proximate the string, said insert having a central threaded opening therethrough, said threaded opening angled at an angle less than 90-degrees with respect to said fretboard; and a machine screw threadably received by said insert threaded opening, said machine screw having a head with an underside, said machine screw adapted to secure the string in a locked downward "V" catch to hold the string against the fretboard whereby the pitch of the string, when vibrating, may be selectively changed from the pitch it vibrates at between the two points.

2. The positioner as defined in claim 1 wherein said means to secure the string further includes positioning said insert proximate a selected fret in order that the string, when held down against the fretboard, is also held down over said selected fret whereby the pitch of the vibrating string may be selectively varied.

3. The positioner as defined in claim 2 wherein said means to secure the string includes positioning said insert proximate said selected fret such that when the machine screw head holds the string down against the fretboard, the string is not moved laterally from its unsecured position.

4. The positioner as defined in claim 3 wherein said insert central threaded opening is angled at an angle of 55 degrees with respect to the fretboard in order that the machine screw, when threaded into said insert, also is at a 55 degree angle with respect to the fretboard whereby the string is held in a downward "V" catch formed by the machine screw head.

5. The positioner as defined in claim 4 wherein said positioner includes a plurality of positioners fixedly attached to the fretboard proximate a plurality of frets.

6. The positioner as defined in claim 5 wherein said insert fixedly attached to the fretboard defines said insert fixedly attached below the fretboard surface whereby said machine screws, when not securing the string, may be below the fretboard surface.

7. On a fretted multiple stringed musical instrument having the vibrational lengths of the plurality of strings stretched between two points overlying a plurality of frets on the instrument fretboard surface, a plurality of positioners mechanically fingering the strings to selectively vary the strings vibrational pitches comprising:

a plurality of inserts fixedly attached to the fretboard of the stringed instrument proximate the plurality of strings and proximate the plurality of frets, said inserts each having a central threaded opening therethrough, said threaded opening angled with respect to said fretboard at an angle less than 90-degrees; and a plurality of machine screws threadably received by said threaded openings of said plurality of inserts, said machine screws including heads having an underside adapted to secure the strings in a locked downward "V" catch against the fretboard whereby the strings are held down over the frets and the pitches of the strings, when vibrating, may be selectively changed from the pitches they vibrate between the two points.

* * * * *